US006565230B2

(12) United States Patent
Ashley

(10) Patent No.: US 6,565,230 B2
(45) Date of Patent: May 20, 2003

(54) RECESSED LIGHT FIXTURE CONVERTED TO LOWER VOLTAGE HALOGEN FIXTURE

(76) Inventor: Josh Ashley, 7 Venezia, Newport Coast, CA (US) 92657

( * ) Notice: Subject to any disclaimer, the term of this patent is extended or adjusted under 35 U.S.C. 154(b) by 58 days.

(21) Appl. No.: 09/855,409

(22) Filed: May 15, 2001

(65) Prior Publication Data

US 2002/0172047 A1 Nov. 21, 2002

(51) Int. Cl.[7] ..... H01R 33/00; F21V 29/00
(52) U.S. Cl. ..... 362/226; 315/279; 362/373
(58) Field of Search ..... 315/279; 362/226, 362/260, 263, 304, 305, 368, 216, 365, 373

(56) References Cited

U.S. PATENT DOCUMENTS 5,073,845 A * 12/1991 Aubrey ..... 362/226
5,463,540 A * 10/1995 Jones ..... 362/216
5,580,158 A * 12/1996 Aubrey et al. ..... 362/226
5,716,125 A * 2/1998 Aubrey ..... 362/260
6,095,671 A * 8/2000 Hutain ..... 362/264
6,350,046 B1 * 2/2002 Lau ..... 362/147

* cited by examiner

*Primary Examiner*—Don Wong
*Assistant Examiner*—Chuc D Tran
(74) *Attorney, Agent, or Firm*—Stetina Brunda Garred & Brucker

(57) ABSTRACT

A method for converting a higher voltage recessed light fixture such as a fixture having an Edison base to a second lower voltage halogen fixture, and a retrofitted recessed light fixture for providing a halogen bulb light source. The light fixture includes an open-end housing, a higher voltage connection base disposed within the housing, and a transformer with a base connector element complimentary to the connection base and connected into the base. The transformer provides halogen bulb voltage and accepts a halogen bulb. An end enclosure covers the open end of the housing except for an opening there through which exposes the illumination face of the halogen bulb. Connecting the halogen bulb to the transformer and applying electric power through the base results in illumination delivery from the halogen bulb in a modernistically appearing light fixture.

36 Claims, 2 Drawing Sheets

RECESSED LIGHT FIXTURE CONVERTED TO LOWER VOLTAGE HALOGEN FIXTURE

CROSS REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates in general to recessed light fixtures, and in particular to a recessed higher voltage light fixture such as an Edison-base fixture converted to a lower voltage halogen fixture in which a transformer such as with an Edison base connector member interfaces the Edison base and a low voltage halogen bulb while a fixture-opening cover member modifies the fixture such that only the face of the halogen bulb is exposed.

The use of recessed lighting fixtures, and especially those mounted in ceilings, is very popular in both commercial and residential settings. These fixtures generally include a cylindrical housing having an open end mounted flush with the ceiling structure and a light bulb within the housing. Traditional recessed fixtures typically can have standard Edison bases which are interiorly threaded to accept external threads of a neck portion of a standard generally spherical, spot, or teardrop shaped light bulb. Both the Edison base and the neck portion of the bulb are of relatively large diameter, and the fixture typically delivers 110 volts for bulb illumination.

While these prior art fixtures have great utility in providing usually diffuse illumination to a room, hallway, or the like, they are not able to provide a light source emanating from a relatively low-voltage halogen bulb whose illumination can be very bright and whose aimed direction can be very specific. Such lighting is very effective in creating special illumination for such things as artwork, pathways, and other sites where brightly targeted light is beneficial.

However, to accomplish this special lighting, a user presently is forced to purchase and install complete replacement fixtures that are able to accommodate these low-voltage (e.g. 12 volts) halogen bulbs. As is apparent, this requirement can be expensive, time consuming, and quite disruptive to the locations during such removal and replacement activities. In view of these significant shortcomings in the prior art, it is apparent that a need is present for providing a retrofitable light fixture such as an Edison-base recessed light fixture which can accommodate both standard and low-voltage halogen bulbs. In response to this need, the primary object of the present invention is to provide an open-end recessed light fixture converted to a low-voltage halogen light fixture.

Another object of the present invention is to provide an Edison-base size recessed light fixture wherein an open-end cover is sized to expose only the illumination face of an in-place halogen bulb.

Still another object of the present invention is to provide methodology for converting an Edison-base size recessed light fixture to a lower voltage halogen bulb light fixture.

These and other objects of the present invention will become apparent throughout the description thereof which now follows.

BRIEF SUMMARY OF THE INVENTION

The present invention is a method for converting a higher voltage recessed light fixture such as a fixture having a first higher voltage Edison base to a second lower voltage halogen fixture, and a retrofitted recessed light fixture mountable within a surrounding structure such as a ceiling or wall for providing a halogen bulb light source. The light fixture includes a housing recessibly mountable within the structure and having an exposed open end with a border flushably mountable with a surrounding surface of the structure. A higher voltage base such as an Edison base is disposed within the housing, and a transformer with a complimentary connector element such as an Edison base connector element is connected into the base. This transformer is functional to provide halogen bulb voltage (e.g. 12 volts), and has a receptacle for a lamp connector of the halogen bulb. The illumination face of the halogen bulb is disposed inside and toward the opening of the housing. An end enclosure covers the exposed open end of the housing except for a generally concentric opening there through which is generally the size and shape of the illumination face of the halogen bulb. The end enclosure has a planar dimension less than the cross-section dimension of the open end such that the end enclosure fits within the open end and interfacedly abuts the housing for exposing the illumination face of the halogen bulb through the aforementioned concentric opening.

Methodology for converting a recessed open-end light fixture having a higher voltage base such as an Edison base to a lower voltage halogen fixture and delivering illumination from a halogen bulb includes first connecting a transformer with a complimentary connector element such as an Edison base connector element into the base of the fixture. The transformer must be functional to convert voltage sent to the base (e.g. 110 volts) to halogen bulb voltage (e.g. 12 volts) for delivery to the halogen bulb, and must have a receptacle for a lamp connector of a halogen bulb. Connecting the halogen bulb to the transformer and applying electric power to the transformer through the base results in illumination delivery from the halogen bulb. An end enclosure can be provided and inserted into the open end for covering the open end except for a generally concentric opening through the enclosure for exposing the illumination face of the halogen bulb. As is apparent, the retrofitted recessed light fixture and methodology of the present invention permit rapid and beneficial conversion of standard-bulb lighting fixtures into halogen-bulb lighting fixtures for effective and low cost illumination delivery.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
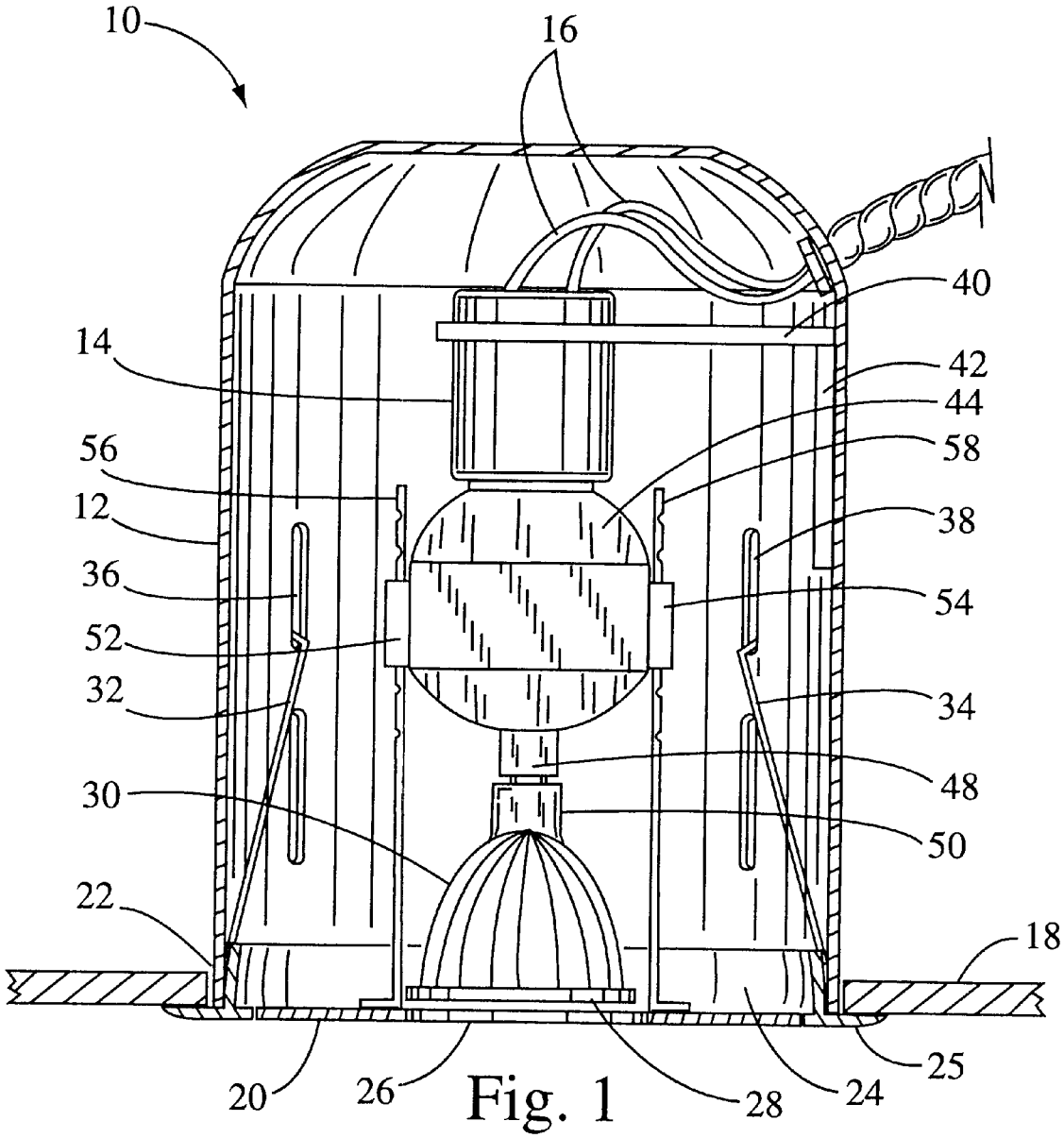
FIG. 1 is a side elevation view partially in section showing a recessed light fixture for accommodating a halogen bulb.

Referring first to FIG. 1, a standard Edison base recessed lighting fixture 10 is shown. The fixture 10 includes a generally cylindrical housing 12 with an Edison base 14 to which standard electrical wires 16 lead and typically deliver 110 volts. The fixture 10 is recess-mounted in a surrounding structure 18, here a ceiling structure, with the housing 12 having a generally circular open end 20 with a border 22 here non-limitedly exemplified as including a laterally-extending flange 25. An end enclosure 24 having a generally concentric opening 26 there through covers the open end 20 of the housing 12 except for the opening 26 thereof which is generally the size and shape of the thus-exposed illumination face 28 of the halogen bulb 30 shown in place in FIG. 1. This end enclosure 24 has a planar dimension slightly smaller than the cross-section dimension of the open end 20 of the housing 12 such that the end enclosure 24 fits within the open end 20 to be flush with the border 22 and interfacedly abuts the housing to thereby exteriorly expose solely the illumination face 28 of the halogen bulb 30. Respective hooks 32, 34 extend from the end enclosure 24 for engagement with respective openings 36, 38 of the housing 12 to retain the end enclosure 24 in place.

Figure 2:
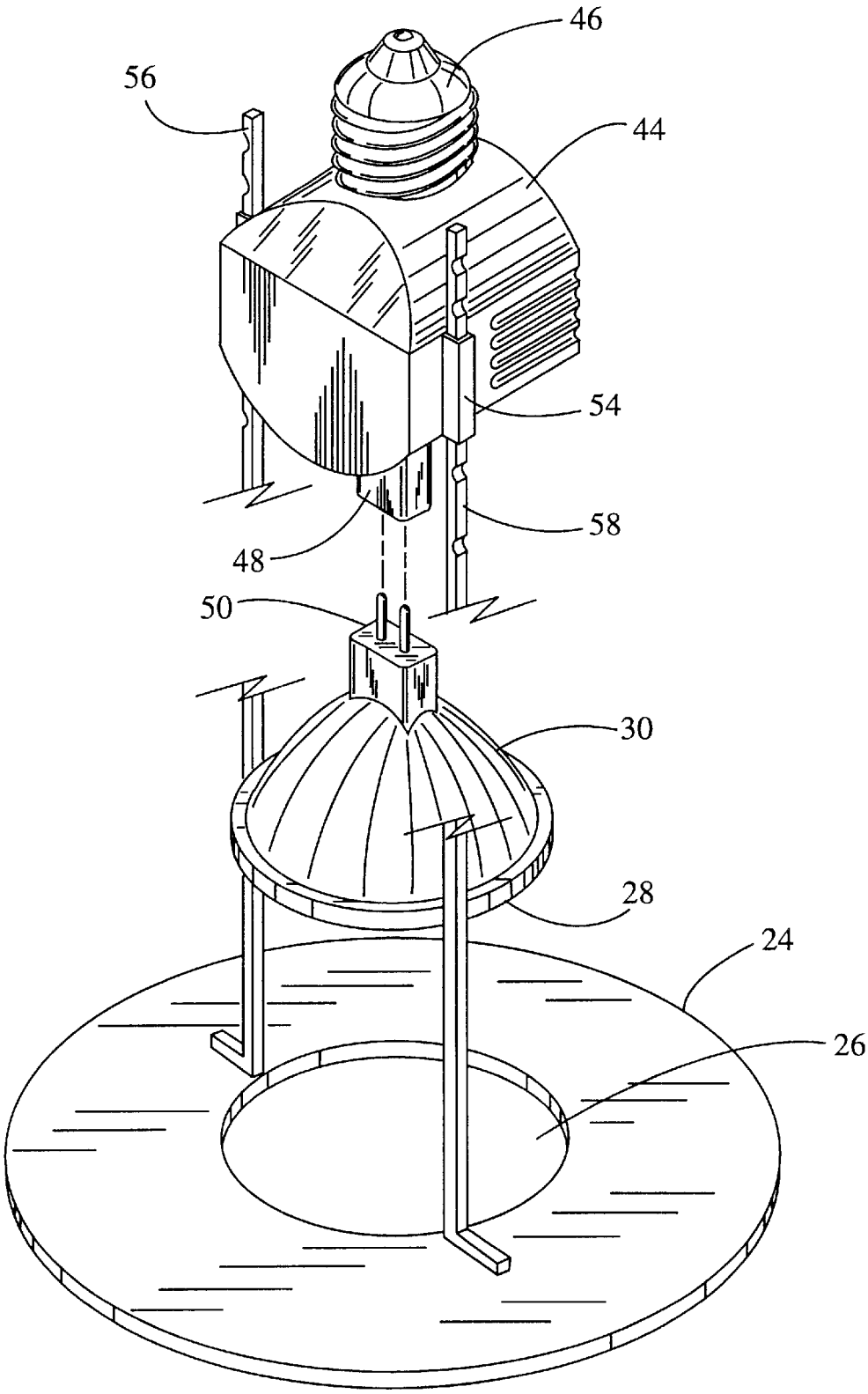
FIG. 2 is an exploded perspective view of the transformer, halogen bulb, and cover shown in FIG. 1.

FIG. 2 clearly illustrates the transformer 44 in relation to its connection with the Edison base 14 of the fixture 10. In particular, the transformer 44 has an Edison base connector element 46 at one end thereof that screws into the Edison base 14 and a receptacle 48, which can be fixed or axially slidable, at the opposite end thereof for accepting a lamp connector 50 of the halogen bulb 30. It is to be understood that, while the preferred embodiment here described employs Edison-type interconnection, other complimentary base and connector configurations can be employed. Depending upon transformer construction and its heat production, an appropriate heat sink (not shown) can be provided for any required cooling. As shown in both FIGS. 1 and 2, the transformer 44 is provided with opposing detente-containing channels 52, 54 engaged with respective notched rods 56, 58 positioned within the housing 12, while the Edison base 14 is mounted on a lateral standard 40 that can slide within a track 42 to thereby provide limited axial movement of the Edison base 14 within the housing 12. As is apparent in FIG. 1, the combination of the standard 40 and track 42 with the notched rod-engaged channels 52, 54 permits limited axial movement of the transformer 44 and connected halogen bulb 30 such that the illumination face 28 of the halogen bulb 30 can be positioned within the opening 26 of the end enclosure 24. Such flexibility, of course, means that the retrofitted fixture appears identical to those fixtures specifically made for halogen bulb illumination. The end enclosure 24 can be fabricated of a translucent material such as plastic and can be tinted with any desired color for added aesthetic effect. The novel lighting fixture and related methodology here defined permit significant illumination upgrading with minimal expense and with no reconstruction.

While an illustrative and presently preferred embodiment of the invention has been described in detail herein, it is to be understood that the inventive concepts may be otherwise variously embodied and employed and that the appended claims are intended to be construed to include such variations except insofar as limited by prior art.

What is claimed is:

1. A method for converting a recessed light fixture having a first higher voltage connection base to a lower voltage halogen fixture and delivering illumination from a halogen bulb, said light fixture having a housing and an exposed open end with a cross-section dimension and with a border flushably mounted with a surrounding structural surface, the method comprising:

a) connecting a transformer with a base connector element complimentary to the connection base into the connection base, said transformer functional to deliver halogen bulb voltage and having a receptacle for a lamp connector of the halogen bulb, said bulb having an exposed illumination face;

b) connecting the halogen bulb to the transformer and applying electric power to the transformer; and c) providing an end enclosure for covering the exposed open end of the housing except for a generally concentric opening through said end enclosure substantially the size and shape of the illumination face of the halogen bulb, said end enclosure having a planar dimension less than the cross-section dimension of the open end such that the end enclosure fits within the open end and interfacedly abuts the housing.

2. A method as claimed in claim 1 additionally comprising:

providing a track apparatus to the transformer for manual height adjustability of said transformer.

3. A method for converting a recessed light fixture having an Edison base to a lower voltage halogen fixture and delivering illumination from a halogen bulb, said light fixture having a housing and an exposed open end with a cross-section dimension and with a border flushably mountable with a surrounding structural surface, the method comprising:

a) connecting a transformer with an Edison base connector element into the Edison base, said transformer functional to deliver halogen bulb voltage and having a receptacle for a lamp connector of the halogen bulb, said bulb having an exposed illumination face;

b) connecting the halogen bulb to the transformer and applying electric power to the transformer; and c) providing an end enclosure for covering the exposed open end of the housing except for a generally concentric opening through said end enclosure substantially the size and shape of the illumination face of the halogen bulb, said end enclosure having a planar dimension less than the cross-section dimension of the open end such that the end enclosure fits within the open end and interfacedly abuts the housing.

4. A method as claimed in claim 3 additionally comprising:

providing a track apparatus to the transformer for manual height adjustability of said transformer.

5. A light fixture mountable within a surrounding structure for providing a halogen bulb light source, the light fixture comprising:

a) a housing recessibly mountable within the structure, said housing having an exposed open end with a cross-section dimension and with a border flushably mountable with a surrounding surface of the structure;

b) a first higher voltage connection base disposed within the housing;

c) a transformer with a base connector element complimentary to the connection base, said transformer functional to deliver a second lower voltage halogen bulb voltage and having a receptacle for a lamp connector of the halogen bulb, said bulb having an exposed illumination face disposed inside and toward the opening of the housing; and d) an end enclosure for covering the exposed open end of the housing except for a generally concentric opening through said end enclosure substantially the size and shape of the illumination face of the halogen bulb, said end enclosure having a planar dimension less than the cross-section dimension of the open end such that the end enclosure fits within the open end and interfacedly abuts the housing for exposing the illumination face of the halogen bulb through said concentric opening.

6. A light fixture as claimed in claim 5 additionally comprising a track structure upon which the transformer can be slidably mounted for axial movement toward and away from the concentric opening of the end enclosure.

7. A light fixture as claimed in claim 5 wherein the housing is generally cylindrical.

8. A light fixture as claimed in claim 5 wherein the cross section dimension of the open end of the housing is generally circular.

9. A light fixture as claimed in claim 5 wherein the border of the open end of the housing additionally includes a laterally-extending flange.

10. A light fixture as claimed in claim 5 wherein the end enclosure is translucent.

11. A light fixture as claimed in claim 10 wherein the end enclosure is colored.

12. A light fixture mountable within a surrounding structure for providing a halogen bulb light source, the light fixture comprising:

a) a housing recessibly mountable within the structure, said housing having an exposed open end with a cross-section dimension and with a border flushably mountable with a surrounding surface of the structure;

b) an Edison base disposed within the housing;

c) a transformer with an Edison base connector element connected into the Edison base disposed within the housing, said transformer functional to provide halogen bulb voltage and having a receptacle for a lamp connector of the halogen bulb, said bulb having an exposed illumination face disposed inside and toward the opening of the housing; and d) an end enclosure for covering the exposed open end of the housing except for a generally concentric opening through said end enclosure the size and shape of the illumination face of the halogen bulb, said end enclosure having a planar dimension less than the cross-section dimension of the open end such that the end enclosure fits within the open end and interfacedly abuts the housing for exposing the illumination face of the halogen bulb through said concentric opening.

13. A light fixture as claimed in claim 12 additionally comprising a track structure upon which the transformer can be slidably mounted for axial movement toward and away from the concentric opening of the end enclosure.

14. A light fixture as claimed in claim 12 wherein the housing is generally cylindrical.

15. A light fixture as claimed in claim 12 wherein the cross section dimension of the open end of the housing is generally circular.

16. A light fixture as claimed in claim 12 wherein the border of the open end of the housing additionally includes a laterally-extending flange.

17. A light fixture as claimed in claim 12 wherein the end enclosure is translucent.

18. A light fixture as claimed in claim 17 wherein the end enclosure is colored.

19. A method for converting a recessed light fixture having a first higher voltage connection base to a lower voltage halogen fixture and delivering illumination from a halogen bulb, said light fixture having a housing and an exposed open end with a cross-section dimension and with a border flushably mounted with a surrounding structural surface, the method comprising:

a) connecting a transformer with a base connector element complimentary to the connection base into the connection base, said transformer functional to deliver halogen bulb voltage and having a receptacle for a lamp connector of the halogen bulb, said bulb having an exposed illumination face;

b) connecting the halogen bulb to the transformer and applying electric power to the transformer; and c) providing an end enclosure for visually obscuring the exposed open end of the housing except for an opening through said end enclosure substantially the size and shape of the illumination face of the halogen bulb.

20. A method as in claim 19 additionally comprising:

providing a track apparatus to the transformer for manual height adjustability of said transformer.

21. A method for converting a recessed light fixture having an Edison base to a lower voltage halogen fixture and delivering illumination from a halogen bulb, said light fixture having a housing and an exposed open end with a cross-section dimension and with a border flushably mountable with a surrounding structural surface, the method comprising:

a) connecting a transformer with an Edison base connector element into the Edison base, said transformer functional to deliver halogen bulb voltage and having a receptacle for a lamp connector of the halogen bulb, said bulb having an exposed illumination face;

b) connecting the halogen bulb to the transformer and applying electric power to the transformer; and c) providing an end enclosure for visually obscuring the exposed open end of the housing except for an opening through said end enclosure substantially the size and shape of the illumination face of the halogen bulb.

22. A method as claimed in claim 21 additionally comprising:

providing a track apparatus to the transformer for manual height adjustability of said transformer.

23. A light fixture mountable within a surrounding structure for providing a halogen bulb light source, the light fixture comprising:

a) a housing recessibly mountable within the structure, said housing having an exposed open end with a cross-section dimension and with a border flushably mountable with a surrounding surface of the structure;

b) a first higher voltage connection base disposed within the housing;

c) a transformer with a base connector element complimentary to the connection base, said transformer functional to deliver a second lower voltage halogen bulb voltage and having a receptacle for a lamp connector of the halogen bulb, said bulb having an exposed illumination face disposed inside and toward the opening of the housing; and d) an end enclosure for visually obscuring the exposed open end of the housing except for an opening through said end enclosure substantially the size and shape of the illumination face of the halogen bulb.

24. A light fixture as claimed in claim 23 additionally comprising a track structure upon which the transformer can be mounted.

25. A light fixture as claimed in claim 23 wherein the housing in generally cylindrical.

26. A light fixture as claimed in claim 23 wherein the cross-section dimension of the open end of the housing in generally circular.

27. A light fixture as claimed in claim 23 wherein the border of the open end of the housing additionally includes a laterally-extending flange.

28. A light fixture as claimed in claim 23 wherein the end enclosure is translucent.

29. a light fixture as claimed in claim 28 wherein the end enclosure is colored.

30. A light fixture mountable within a surrounding structure for providing a halogen bulb light source, the light fixture comprising:

a) a housing recessibly mountable within the structure, said housing having an exposed open end with a cross-section dimension and with a border flushably mountable with a surrounding surface of the structure;

b) an Edison base disposed within the housing;

c) a transformer with an Edison base connector element connected into the Edison base disposed within the housing, said transformer functional to provide halogen bulb voltage and having a receptacle for a lamp connector of the halogen bulb, said bulb having an exposed illumination face disposed inside and toward the opening of the housing; and d) providing an end enclosure for visually obscuring the exposed open end of the housing except for an opening through said end enclosure substantially the size and shape of the illumination face of the halogen bulb.

31. A light fixture as claimed in claim 30 additionally comprising a track structure upon which the transformer can be mounted.

32. A light fixture as claimed in claim 30 wherein the housing is generally cylindrical.

33. A light fixture as claimed in claim 30 where in the cross-section dimension of the open end of the housing in generally circular.

34. A light fixture as claimed in claim 30 wherein the border of the open end of the housing additionally includes a laterally-extending flange.

35. A light fixture as claimed in claim 30 wherein the end enclosure is translucent.

36. A light fixture as claimed in claim 35 wherein the end enclosure is colored.

* * * * *